US006164503A

United States Patent [19]

Forsyth et al.

[11] Patent Number: 6,164,503

[45] Date of Patent: Dec. 26, 2000

[54] CLOSURE FOR LIQUIDS

[75] Inventors: Michael J. Forsyth, Stow; David C. Baxter, Southington, both of Ohio

[73] Assignee: Weatherchem Corporation, Twinsburg, Ohio

[21] Appl. No.: 09/232,343

[22] Filed: Jan. 15, 1999

[51] Int. Cl.[7] ..... B67D 3/00; B67D 5/32; B65D 51/22; B65D 41/00; B65D 53/00

[52] U.S. Cl. ..... 222/556; 222/153.05; 220/258; 215/351; 215/232

[58] Field of Search ..... 222/541.1, 556, 222/562; 220/254, 256, 258, 259, 837, 847; 215/232, 237, 235, 349, 351

[56] References Cited

U.S. PATENT DOCUMENTS

| | | | |
|---|---|---|---|
| D. 340,188 | 10/1993 | Forsyth | D9/449 |
| 3,033,407 | 5/1962 | Isele-Aregger | 215/351 |
| 3,675,812 | 7/1972 | Foster | 220/31 S |
| 4,651,885 | 3/1987 | Gach | 215/250 |
| 4,693,399 | 9/1987 | Hickman et al. | 222/480 |
| 4,893,718 | 1/1990 | Delespaul et al. | 215/232 |
| 4,936,494 | 6/1990 | Weidman | 222/480 |
| 4,940,167 | 7/1990 | Fillmore et al. | 222/153 |
| 5,048,730 | 9/1991 | Forsyth et al. | 222/482 |
| 5,330,082 | 7/1994 | Forsyth | 222/480 |
| 5,566,850 | 10/1996 | Forsyth et al. | 220/553 |
| 5,667,089 | 9/1997 | Moore | 215/351 |

*Primary Examiner*—Kevin Shaver
*Assistant Examiner*—David A. Bonderer
*Attorney, Agent, or Firm*—Pearne & Gordon LLP

[57] ABSTRACT

A screw-on closure for bottles that initially works with an induction seal liner and provides a leak resistant reseal on the bottle after the liner is removed. The closure has a unique annular convex sealing surface that overlies the mouth of the bottle. The sealing surface and the closure body area supporting it are sufficiently massive to withstand the heat generated in an induction liner sealing process and have a geometry that promotes a line contact with the mouth of the bottle to ensure a drip resistant reclose. A dispensing aperture of the cap is sealed by a hinged flap that has its sealing surface areas strategically located relative to the hinge to ensure repeated drip free opening and closing dispensing operation.

17 Claims, 3 Drawing Sheets

CLOSURE FOR LIQUIDS

BACKGROUND OF THE INVENTION

The present invention relates to injection molded thermoplastic closures for bottles and like containers and, in particular, to such closures with improved sealing capabilities.

U.S. Pat. Nos. 4,693,399, 4,936,494, 5,048,730 and 5,330,082 disclose flap type screw-on dispensing closures. In particular, U.S. Pat. No. 5,048,730 discloses a type of cap that has features to improve moisture resistance. Dispensing caps, particularly those combined with a package for liquids are often used with a separate liner that forms a one-time seal onto the mouth of a bottle. Typically, such seals are of the induction type well known in the art. As far as is known, there has been an unfulfilled need for a dispensing closure that has a capability of resealing the bottle mouth with an effectiveness sufficient to be drip resistant and/or highly moisture resistant. Among the problems encountered in making a suitable closure is that the resealability should be achieved at relatively low application torque so that the closure can be used by a person with low hand strength, low finger dexterity and/or with a low attention level. Induction sealed liners are frequently used in the packaging industry because of the performance that can be achieved with this liner. The problem that this type of liner introduces is that the heat generated during the induction process can adversely affect the sealing surface of the cap. Where the sealing surface is originally relatively flat, a good induction seal can be achieved, but the resealability of the cap can be defeated where the heat causes the cap sealing surface to permanently deform and conform to the irregularities in the mouth of the bottle. Thin annular formations in the sealing area of the cap such as shown in the aforementioned U.S. Pat. No. 5,048,730 can also be damaged by the heat of the induction sealing process.

In addition to the difficulty in providing resealability with the mouth of a bottle, there are problems with sealing the flap of a flap-type closure. These problems are exacerbated where the closures are produced in large multi-cavity molds for reasons of economy. It is difficult to maintain accuracy between the two halves of a large multicavity mold because the mold halves can thermally expand at different rates during a production run.

SUMMARY OF THIE INVENTION

The invention provides a screw-on dispensing cap that is usable with an induction seal liner and that is capable of providing a drip resistant reseal on the mouth of bottle after the liner has been removed. As disclosed, the cap or closure has a bottle sealing zone with an annular moderately convex surface and with sufficient mass to resist significant thermal distortion during induction heating of the liner. The convex surface has been found to provide adequate sealing capabilities with the liner and, with the liner removed, to advantageously promote a line contact relationship with the mouth of the bottle. This line contact permits the cap to achieve a drip resistant seal with the bottle mouth even at relatively low levels of retightening torque thereby making the cap convenient for the consumer to use.

In accordance with another feature of the invention, the cap includes a dispensing aperture and a flap for selectively closing and opening the aperture. The flap and aperture have cooperating elements that provide a drip resistant seal. The disclosed flap seal configuration is capable of being mass produced in large cavity number molds while retaining reliable sealing characteristics both as manufactured and after repeated use. Still further, the flap configuration is of a type which demonstrates a surprising resistance to popping open when subjected to internal hydraulic pressures such as occur when a plastic bottle is dropped or squeezed excessively.

DESCRIPTION OF THE PREFERRED EMBODIMENT

Figure 1:
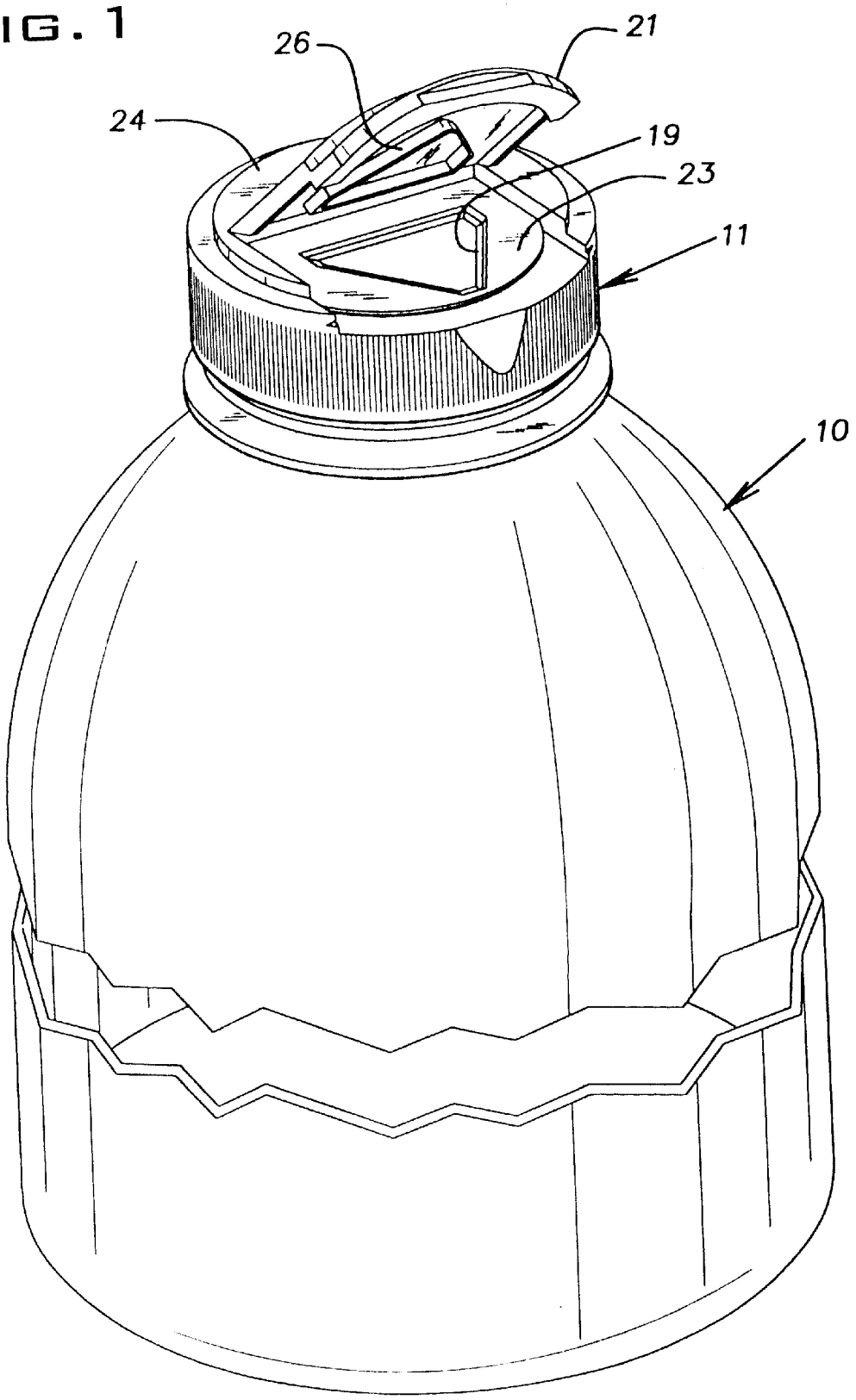
FIG. 1 is a perspective view of a bottle and cap constructed in accordance with the present invention.

Referring now to the drawings, there is shown a bottle 10 and a cap 11. The bottle 10 can be molded of suitable material, preferably a transparent thermoplastic material and is preferably a blow-molded unit with an injection molded neck finish. The neck 12 can ideally be molded of CPET, crystallized polyethylene terephthalate, to achieve a relatively dimensionally accurate and stable construction. The bottle neck 12 has a generally conventional cylindrical configuration with external threads 13 and a circular mouth 14. The mouth or upper lip 14 is molded in a desired flat plane transverse to the axis of the neck 12 although it is usual for the neck to deviate from a perfect plane and perfect circle as the result of conventional molding practices.

The illustrated cap or closure 11 is a nominal 43 mm. unit and is injection molded as a one-piece part of suitable thermoplastic material such as polypropylene. The cap 11 includes a cylindrical skirt 16 and a circular end wall 17 at the top of the end wall. The skirt 16 has internal threads 18 configured to mate with the threads 13 on the bottle neck 12. The end wall 17 extends generally in a plane transverse to the axis of the skirt 16. In the illustrated case, the cap 11 has a single dispensing aperture 19 in the end wall. As shown, the aperture or hole 19 is eccentric of the center of the end wall 17 and has a triangular shape when viewed from above the cap. The aperture 19 is oriented with one of its corners adjacent the skirt 16. This configuration where the aperture is smaller in a direction transverse to a radial line from the center of the cap to the part of the aperture closest to the skirt, assists the control of pouring action of liquids from the bottle 10.

The aperture 19 is selectively closed or opened by a flap 21 connected to the main part of the end wall 17 by a living hinge 22. The hinge 22 extends across the end wall 17 along a chordal line. In the illustrated case, the end wall 17 is configured with a step down section 23 surrounding the aperture 19 so that when the flap 21 is closed, the flap is generally flush with major areas of the upper or outside surface designated 24 of the end wall.

Figure 2:
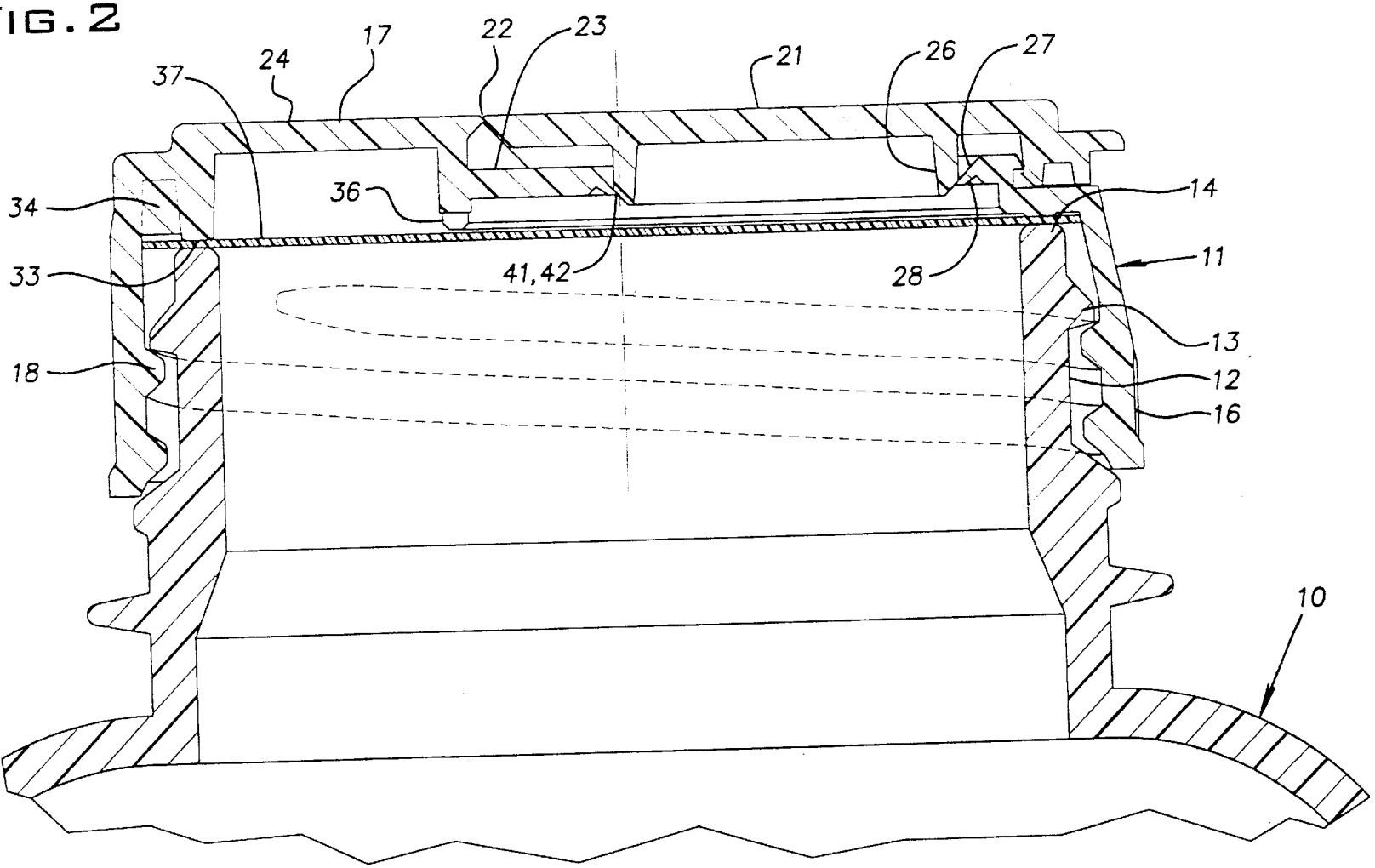
FIG. 2 is an enlarged cross-sectional view of the threaded neck finish of the bottle, the cap and an induction liner.
Figure 3:
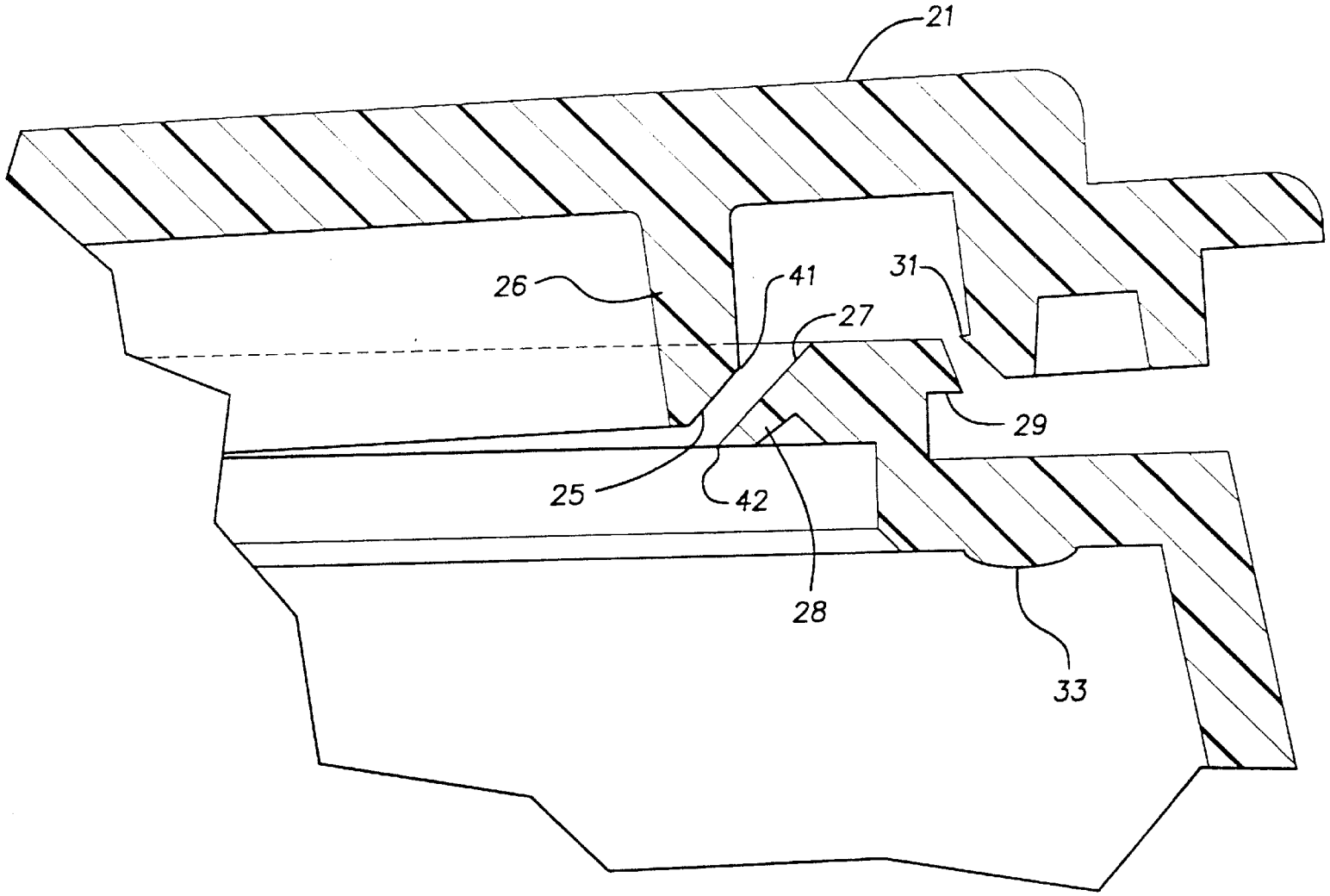
FIG. 3 illustrates the flap and associated plug of the cap in a slightly open relation to the dispensing opening.

A triangular hollow plug 26 formed on the underside of the flap 21 is arranged with a shape complimentary to the aperture 19 and to fit tightly into the aperture when the flap is closed. As shown in FIGS. 2 and 3, lower edges 25 of the plug 26 are tapered inwardly towards the geometric center of the plug with increasing distance from the flap proper to assist the plug in registering with the aperture 19. Edge surfaces 27 forming the aperture 19 taper inwardly, like the plug 26 in the downward or axially inward direction. If desired, the underside of the end wall 17 surrounding the aperture 19 can be grooved or recessed to form a relatively thin wall section 28. The thin wall section 28 can help the aperture 19 resiliently conform and seal with the flap plug 26.

A flap retaining catch or latch is formed on the end wall 17 externally of the aperture 19 and remote from the hinge 22. The catch 29 cooperates with a mating catch element 31 on the underside of the flap 21. The catch elements 29, 31 are like those described in aforementioned U.S. Pat. No. 5,330,082. The arrangement of the catch elements is such that when the end wall 17 is deflected by internal forces such as fluid pressure within the bottle as can occur if the bottle is dropped or excessively squeezed the retention force is increased.

An annular sealing surface area 33 is formed on the underside of the cap end wall 17 at a location that directly overlies the mouth 14 of the bottle. The sealing area 33 is spaced radially inwardly from the skirt 16. Reinforcing ribs 34 such as disclosed in aforementioned U.S. Pat. No. 4,936,494 are disposed in the area between the inner periphery of the skirt and the sealing area 33. The annular sealing area 33, in accordance with the invention, is convex in cross-section (as shown in FIGS. 2 and 3) preferably taking the form of a truncated torroid. By way of example, the radius of the curve (in a radial plane along the axis of the cap) defining the torroid is about 0.10 inches for the disclosed 43 mm. size cap. Ideally, the lowermost part of the torroid sealing area 33 is generally centered radially over the mouth or lip 14, i.e. at a radius midway between the inside diameter and outside diameter of the mouth. A chordal rib 36 on the underside of the end wall 17 provides a lower surface that is at or slightly above the plane of the lowermost part of the sealing surface area 33 enabling it to support a liner 37. The liner 37, in a conventional practice, is assembled within the cap 11 prior to assembly of the cap on the bottle 10. Typically, the liner 37, which is a circular sheet, is retained in the cap by an interference fit and/or integral peripheral tabs that bear against the threads once assembled in the cap. The liner 37 is preferably an induction seal-type liner selected from known constructions suitable for use with the material of the bottle neck 12. After the bottle or container 10 is filled with product through the mouth 14, the cap 11, carrying the liner 37, is assembled and screwed tightly onto the bottle typically by an automatic capping machine. Thereafter, the bottle 10 is conveyed into an induction sealing device where the liner 37 is inductively heated to cause it to adhere and seal to the mouth 14.

The disclosed cap 11 is particularly suited for use on bottles containing liquids. When a consumer wishes to dispense the contents of the bottle, the cap is first unscrewed to provide access to the liner 37. The liner 37 is peeled off the bottle mouth and the cap 11 is screwed back onto the bottle. With the flap 21 open, the triangular aperture 19 works like a weir in regulating the rate and direction of flow of liquid.

The plug 26 and aperture 19 are configured so that they contact with an interference liquid leak-resistant seal or plug fit at their lower or axially inward portions designated 41 and 42, respectively. As shown in FIG. 2, the line or band of sealing contact between the plug 26 and aperture 19 is spaced axially below the hinge 22. The tapered surfaces 27, 25 of the aperture and of the plug and the elevation of the hinge 22 above the sealing edges 41, 42 ensure that the plug and edge surfaces do not create an "over center" condition where material is compressed and deflected during closing movement and then somewhat relaxed before reaching the final closed position. Such a condition would otherwise potentially lead to excessive wear and possible leakage.

In the disclosed embodiment, the tapered surface 27 of the aperture 19 is formed by a mold surface that is carried with the mold surfaces that form the plug 26. This ensures dimensional and positional accuracy of the plug 26 relative to the aperture 19 even in large multicavity tooling.

During the induction sealing operation, heat is generated in the liner to cause it to adhere to the mouth 14 of the bottle 10. This heating process has been found to allow the sealing area of a cap to permanently deform and tend to conform to the shape of the bottle mouth. In general, the bottle will not have a perfectly planar and perfectly circular shape. This tendency of a cap to deform as a result of the induction heating process makes it difficult to reseal the bottle once the liner is removed because, among other considerations, the absence of a liner requires the cap to screw onto the neck further than it originally did in the presence of the liner. Consequently, the sealing surface does not always register over the bottle mouth with the exact same angular orientation and, therefore, the irregularities impressed upon the sealing surface of the cap do not overlie the pattern of these irregularities on the bottle mouth. As a result, caps in the prior art are difficult to reseal directly on the bottle. The present invention in which the sealing surface area is convex where it overlies the bottle mouth and where it has a substantial mass of material associated with it, has been found to provide improved reseal performance. It is believed that the convex surface such as the disclosed torroid shape has the ability to promote a line contact relationship with the bottle which ensures a circumferentially continuous engagement with a relatively high unit pressure in the contact area for a given retightening torque on the cap. As shown, the sealing surface area exists on a part of the end wall which has substantially at least the thickness of the nominal wall thickness of the cap which in the illustrated example for a 43 mm. cap is about 0.050 inch.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An injection molded thermoplastic screw-on dispensing cap comprising an internally threaded skirt, an end wall integral with the upper end of the skirt, a dispensing aperture in the end wall, a member for selectively opening and closing the aperture to respectively allow or prevent dispensing of the contents of a bottle on which the cap is threaded, the end wall including an annular sealing surface having a radial width that is about the same size as a nominal wall thickness of the cap and being adapted to overlie an edge of a mouth of the bottle, the sealing surface being generally convex across its radial width, the sealing surface having the general shape of a truncated torroid and having sufficient mass and heat transfer characteristics to resist substantial permanent deformation during an induction heating process while it presses an induction seal liner carried in the cap onto the edge of the mouth of a bottle and its convex shape forms a line contact circumferentially continuous seal with the edge of the mouth of the bottle when the liner is removed and the cap is reinstalled to ensure a drip resistant seal therewith upon application of moderate reclosing torque.

2. A dispensing cap as set forth in claim 1, wherein the opening and closing member is a flap connected to the end wall with a living hinge.

3. A dispensing cap as set forth in claim 2, wherein said hinged flap has a plug formation complementary to the configuration of the dispensing aperture and is dimensioned to provide an interference fit in the aperture.

4. A dispensing cap as set forth in claim 3, wherein the plug formation and aperture are adapted to seal with one another along a continuous peripheral zone of contact.

5. A dispensing cap as set forth in claim 4, wherein said zone of contact is below the hinge of the flap.

6. A dispensing cap as set forth in claim 1, including catch elements to retain the opening and closing member in the closed position arranged to increase the retaining action on the member upon an increase in the internal forces applied to the end wall of the cap.

7. A cap as set forth in claim 1, wherein said member is a plug to be received in the aperture with an interference fit.

8. A cap as set forth in claim 7, wherein the plug is tapered in a manner enabling it to self align with the aperture.

9. A cap as set forth in claim 8, wherein the plug and aperture are narrow adjacent an outer edge of the end wall as compared to their respective widths at locations distal from the edge of the end wall.

10. A cap as set forth in claim 1, wherein the aperture closing member is a flap joined on the end wall with a living hinge.

11. A cap as set forth in claim 10, wherein the plug and aperture seal along a line of contact that is below the plane of the hinge a distance at least equal to a nominal wall thickness of the cap.

12. A cap as set forth in claim 10, wherein the flap and end wall have interengaging catch elements that produce a flap retaining action when the flap is in a closed position.

13. A cap as set forth in claim 12, wherein said catch elements are oriented in a manner wherein internal pressure in the cap that tends to deform the end wall outwardly increases the retaining action of the catch elements.

14. A cap as set forth in claim 1, including an induction seal liner retained in the cap adjacent the inner side of the end wall.

15. An assembly comprising a bottle, a one-piece cap and a liner, the bottle having an externally threaded cylindrical neck and an adjacent mouth for admitting and discharging material to and from the interior of the bottle, the cap being injection molded thermoplastic, the cap including a circular skirt and an end wall adjacent an upper end of the skirt, a dispensing aperture in the end wall and a hinged flap on the end wall for selectively closing and opening the aperture, the skirt having internal threads complementary to the threads on the bottle neck, the cap being threaded onto the bottle neck, the end wall having an annular sealing surface above the bottle mouth having a radial width that is about the same size as a nominal wall thickness of the cap, the sealing surface having the general form of a truncated torroid wherein it is convex across its radial width above the mouth of the bottle, the liner being an induction sealing type and being disposed between the bottle mouth and the sealing surface, the sealing surface being formed on an area of the end wall that has sufficient mass to resist gross deformation in the sealing surface area during an induction heating process adequate to adhere the liner to the mouth of the bottle.

16. An injection molded thermoplastic screw-on dispensing cap assembly comprising an internally threaded skirt, an end wall integral with the upper end of the skirt, an induction seal liner within the cap between the threads of the skirt and the end wall, the end wall including an annular sealing surface having a radial width that is about the same size as a nominal wall thickness of the cap and adapted to overlie an edge of a mouth of the bottle, the sealing surface being generally convex in shape in a manner like that of a torroid across its full radial width and having sufficient mass and heat transfer characteristics to resist substantial permanent deformation during an induction heating process while it presses the induction seal liner carried in the cap onto the edge of the mouth of a bottle and wherein its convex shape forms a line contact circumferentially continuous seal with the edge of the mouth of the bottle when the liner is removed and the cap is reinstalled to ensure a drip resistant seal therewith upon application of moderate reclosing torque.

17. An assembly comprising a bottle, a one-piece cap and a liner, the bottle having an externally threaded cylindrical neck and an adjacent mouth for admitting and discharging material to and from the interior of the bottle, the cap being injection molded thermoplastic, the cap including a circular skirt and an end wall adjacent an upper end of the skirt, the skirt having internal threads complementary to the threads on the bottle neck, the cap being threaded onto the bottle neck, the end wall having an annular sealing surface having a radial width that is about the same size as a nominal wall thickness of the cap above the bottle mouth, the sealing surface having the general form of a truncated torroid wherein it is convex across its radial width above the mouth of the bottle, the liner being an induction sealing type and being disposed between the bottle mouth and the sealing surface, the sealing surface being formed on an area of the end wall that has sufficient mass to resist gross deformation in the sealing surface area during an induction heating process adequate to adhere the liner to the mouth of the bottle.

* * * * *